US006986170B2

(12) United States Patent
Nelson

(10) Patent No.: US 6,986,170 B2
(45) Date of Patent: Jan. 17, 2006

(54) FLUID FILLED BODY PADDING FOR FALL PROTECTION

(76) Inventor: Thomas M. Nelson, 10923-89 Avenue, Edmonton, Alberta (CA) T6G 0Z4

( * ) Notice: Subject to any disclaimer, the term of this patent is extended or adjusted under 35 U.S.C. 154(b) by 0 days.

(21) Appl. No.: 10/873,843

(22) Filed: Jun. 22, 2004

(65) Prior Publication Data

US 2005/0278836 A1 Dec. 22, 2005

(51) Int. Cl.
*A41D 13/00* (2006.01)

(52) U.S. Cl. ..... 2/455

(58) Field of Classification Search ..... 2/455, 2/456, 16, 69, 462–465, 467, 410–411, 68, 2/414, 20, 22, 2.5, 102, 70, 92, 161.1, 909–911, 2/227, 267, 268, DIG. 1, DIG. 3; 5/655.4, 5/953, 911, 702; 128/878, 881, 882; 602/23, 602/25, 27, 62, 63, 65; 428/76, 313.5
See application file for complete search history.

(56) References Cited

U.S. PATENT DOCUMENTS 2,298,218 A * 10/1942 Madson ..... 5/655.4
3,304,219 A * 2/1967 Nickerson ..... 428/327
3,459,179 A * 8/1969 Olesen ..... 601/134
3,721,232 A 3/1973 Trenchard
3,748,669 A 7/1973 Warner
3,968,530 A 7/1976 Dyson
4,213,213 A 7/1980 Burnett
4,663,785 A 5/1987 Comparetto
4,728,551 A 3/1988 Jay
4,964,402 A 10/1990 Grim et al.
5,079,786 A 1/1992 Rojas
5,147,685 A 9/1992 Hanson
5,201,544 A 4/1993 Matano et al.
5,497,789 A 3/1996 Zook
5,556,169 A 9/1996 Parrish et al.
5,881,409 A 3/1999 Pearce
6,206,474 B1 3/2001 Kruse et al.
6,279,160 B1 8/2001 Chen
6,447,874 B2 9/2002 Antinori et al.
6,453,477 B1 * 9/2002 Bainbridge et al. ..... 2/455
6,611,980 B2 9/2003 Wempe
6,644,522 B2 11/2003 Preiss

OTHER PUBLICATIONS

Adams, John C.,Hamblen, David L.,"Chapter 14 Thigh and knee 190-1" In "Outline of Fractures, Including Joint Injuries", Tenth Edition. Edinburgh: Churchill Livingstone, 1992.

Browne, Patrick S. H., "Chapter 15 138-9" In "Basic Facts of Fractures", Second Edition. Oxford: Balckwell Scientific Publications, 1988.

(Continued)

*Primary Examiner*—Tejash Patel
(74) *Attorney, Agent, or Firm*—Davis & Bujold, P.L.L.C.

(57) ABSTRACT

A fluid filled body padding for fall protection includes a flexible inner pouch holding a shock absorbing fluid. A flexible outer pouch encapsulates the inner pouch. A fluid interface is provided between the inner pouch and the outer pouch. The fluid interface serves to pressurize and rigidify the inner pouch containing the shock absorbing fluid when a localized force is exerted upon the outer pouch. This body padding is suitable for a variety of fall protection applications, such as hip protectors for senior citizens.

8 Claims, 1 Drawing Sheet

OTHER PUBLICATIONS

Jones, David A,. Koval, Kenneth J., Zuckerman, Joseph D., Aharonoff, Gina B., Skovron, Mary L. "Chapter 1 Epidemiology." In "Fractures in the Edlderly". New York: Lippincott—Raven Publishers, 1998.

Koval, Kenneth J., Zuckerman, Joseph D. "Chapter 16 Hip." In "Fractures in the Elderly". New York: Lippincott—Raven Publishers, 1998.

* cited by examiner

THE FIGURE
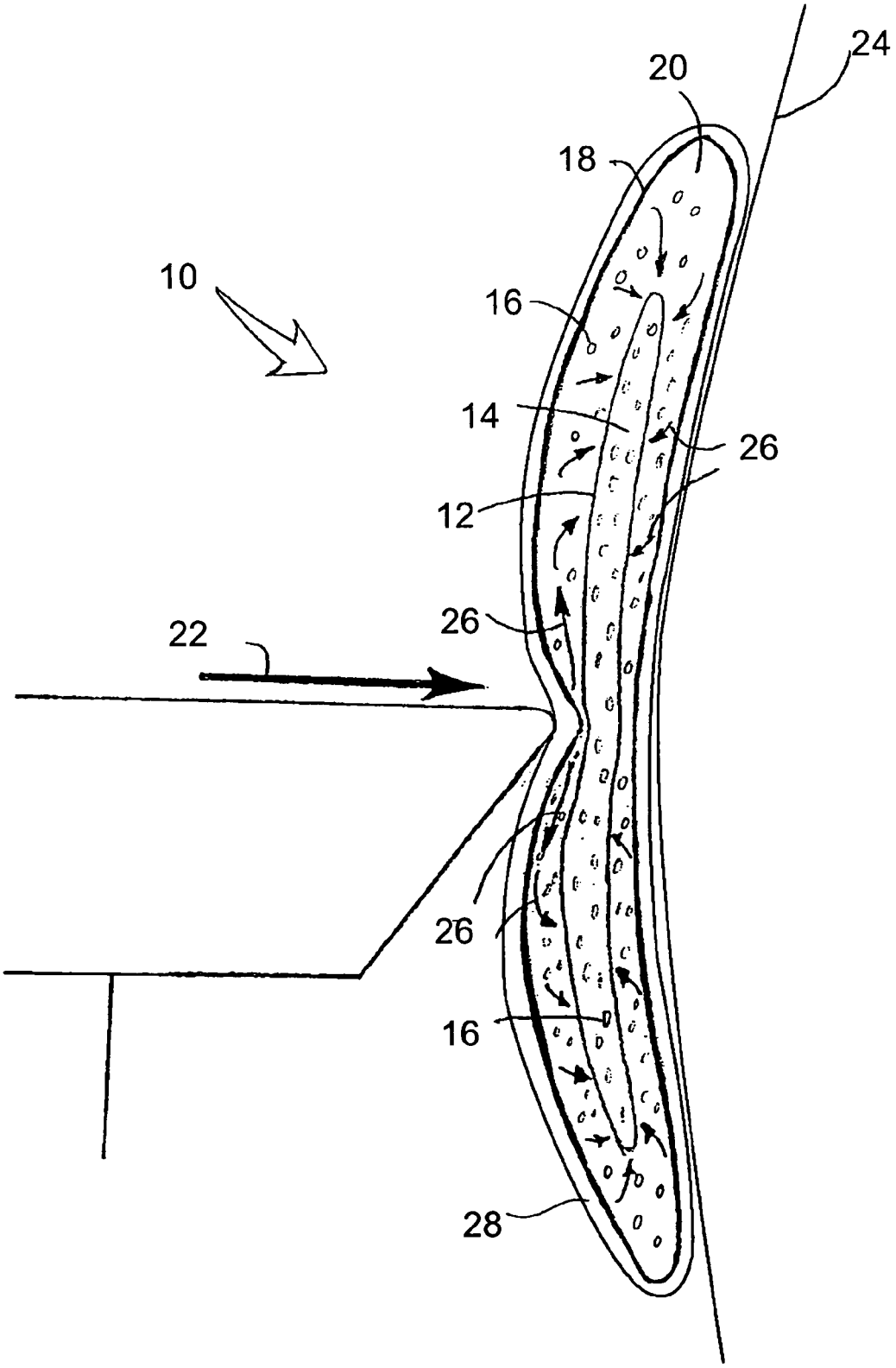

FLUID FILLED BODY PADDING FOR FALL PROTECTION

FIELD OF THE INVENTION

The present invention relates to fluid body padding used for fall protection.

BACKGROUND OF THE INVENTION

Injuries from falls are a common and serious problem for the elderly. Many such injuries could be prevented if thick body padding were worn. However, most elderly persons are too proud to wear body padding, if the fact that they are wearing such body padding is readily apparent to a casual observer.

Whether the fluid medium used is a liquid or a gas, in order to function as fall protection a fluid filled body pad must be fully inflated, like a balloon. If the fluid filled body pad is not fully inflated, they are still suitable for preventing bed sores, but are no longer suitable as fall protection. The reason for this is that in order for a fluid filled body pad to function when it is not fully inflated, pressure must be exerted evenly upon the pad. When a person falls, against a sharp object such as a stone, or the edge of a curb, localized pressure is applied. In response to such localized pressure, the fluid in the fluid filled body pad will be displaced.

SUMMARY OF THE INVENTION

What is required is fluid filled body padding which can provide effective fall protection.

According to the present invention there is provided a fluid filled body padding for fall protection which includes a flexible inner pouch holding a shock absorbing fluid. A flexible outer pouch encapsulates the inner pouch. A fluid interface is provided between the inner pouch and the outer pouch. The fluid interface serves to pressurize and rigidify the inner pouch containing the shock absorbing fluid when a localized force is exerted upon the outer pouch.

With the body padding, as described above, a localized force exerted upon the outer pouch is converted by the liquid interface into an even force which acts uniformly upon the inner pouch. The inner pouch becomes rigid in response to the pressure applied via the liquid interface and is better able to withstanding the localized force resulting from the fall. If the impacting force is sufficiently large, the membrane containing the fluid ruptures to eject the excess localized force resulting from the fall.

Although beneficial results may be obtained through the use of the body padding, as described above, when air is used as a fluid the volume of air required in order to be effective tends to be bulky and when a liquid is used as a fluid the liquid tends to flow to the bottom of the pouch causing the pouch to sag. Even more beneficial results may, therefore, be obtained when the shock absorbing fluid is a viscous gel-like liquid. The viscous gel-like liquid tends to hold its position and reduce sagging. For the same reason, it is preferred that the fluid interface be a viscous gel-like liquid.

Although beneficial results may be obtained through the use of the body padding, as described above, even more beneficial results may be obtained when polymer beads are mixed with the viscous gel-like liquid in the inner pouch. The polymer beads serve to reduce the weight of the fall protection without any significant adverse affect upon its performance.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

THE FIGURE is a side elevation view, in section, of body padding for fall protection constructed in accordance with the teachings of the present invention.

DETAILED DESCRIPTION OF THE PREFERRED EMBODIMENT

The preferred embodiment, fluid filled body padding generally identified by reference numeral 10, will now be described with reference to THE FIGURE.

Structure and Relationship of Parts:

Fluid filled body padding 10 has a flexible inner pouch 12 that holds a viscous gel-like shock absorbing liquid 14. In the illustrated embodiment, polymer beads 16 are mixed with gel-like liquid 14. Body padding 10 is further adapted with a flexible outer pouch 18 that encapsulates inner pouch 12. Foam padding 28 surrounds outer pouch 18. A viscous gel-like liquid interface 20, also shown mixed with polymer beads 16, is interposed between inner pouch 12 and outer pouch 18 such that inner pouch 12 is pressurized and rigidified when a localized force 22 is exerted upon outer pouch 18. Inner and outer pouches 12 and 18 are of materials such that they will break or rupture when excessive force is applied.

Operation:

The use and operation of fluid filled body padding 10 will now be described with reference to THE FIGURE. Where a user desires protection from a possible fall, fluid filled body padding 10 is positioned along the desired body form 24. Due to the flexibility of both inner pouch 12 and outer pouch 18, body padding 10 substantially conforms to the shape. Should the user fall and be struck by a sharp, localized force 22, the force is received by outer pouch 18 and dissipated and converted by viscous gel-like liquid interface 20 and polymer beads 16 into an even force 26 that is applied uniformly to inner pouch 12. Inner pouch 12 is, in turn, rigidified over its area. If an excessive force is applied, inner and outer pouches 12 and 18 may rupture to further reduce the impact. The effect on the user is a neutralization of damaging, localized force and the avoidance of serious injury.

Test Results:

Tested Protectors

The protectors, or fluid filled body padding 10 that were tested consisted of one 6 mm thick foam pad 28 and one 3 mm thick foam pad 28 which enveloped the force reducing device, or FRD. The FRD as described above is comprised of two individual gel packs; a small inner gel pack, inner pouch 12, which is encased inside of a larger gel pack, outer pouch 18. The main structure of the protector is 17.8 cm wide by 25.4 cm in length. The inner FRD is 7.6 cm wide by 15.2 cm in length. The purpose of the testing was to observe what amount of force attenuation the protectors could provide.

Testing System

The impact testing system consisted of a Charpy materials impact tester, which was modified so that it could be used as an impact pendulum. The pendulum had a mass of 40 kg and a center of mass 81.0 cm from its axis of rotation. A striking plate was affixed to the base of the charpy tester, which consisted of a steel plate and some rubber matting. The matting was added to introduce compliance into the system so that there would not be any extremely sharp impulses occurring. A Bruel and Kjaer 4344 accelerometer in conjunction with a Bruel and Kjaer 2511 vibration meter measured the accelerations. The conditioned signal output was monitored by an INSTRUNET model 100 analog/digital data acquisition system and then recorded on a Toshiba satellite A10 laptop. The data-sampling interval was 6 $\mu$s.

Impact Experiments

The impact pendulum was setup to have three nominal peak force settings of 2000 N, 4000 N, and 7000 N with no protectors present. The calibration tests showed the actual peak impact force for the lowest setting of 2000 N, to be 2056 N±58 N. The second peak force setting of 4000 N gave an actual peak impact of 4293 N±74 N. The highest impact setting of 7000 N showed the peak impact to be 7317 N±87 N. During these three experiments the mass of the pendulum remained the same, only the height from which the pendulum was released was altered.

A total of 14 hip protectors were tested. The first set of testing was performed on protectors 1–6, which were struck 5 times at the three peak impact force levels. While testing at the 4000 N peak impact force level, four of the six protectors FRD's ruptured along the seams of the outermost casing. These four protectors were tested after the ruptures occurred in order to see what effect a broken FRD had on the force attenuation characteristics of the protector. A second set of testing was done with protectors 7–14 with each protector having a single strike at either the 4000 N or the 7000 N setting. Finally, a protector without the FRD was tested a total of 5 times at each of the impact settings so that a comparison could be made to see what effect the addition of the FRD had.

Results and Discussion

2000 N Tests

Protectors 1–6 were each struck five separate times at this setting. None of the FRD's failed at the 2000 N setting. The hip protectors had an average reduction of force of 921 N (44%) for the first strike compared to the fifth strike average, which produced a decrease of 789 N (38%), and an overall average decrease of 842 N (40%). The average reduction of force for the foam padding (the protector without the FRD) was 674 N (30%).

The 6% difference between the average force reduction for the first strike as compared to the fifth strike shows a slight trend wherein the more strikes that the protectors were subjected too, the less their ability to attenuate the impact force.

Some variability between the amounts of force attenuated by each protector was also found. For example, protector 1 had an average force attenuation of 791 N while protector 6 had an average force attenuation of 885 N. This variability is most likely attributed to the repeatability of the protector construction process.

4000 N Tests

There were a total of eight separate protectors tested at the 4000 N setting. Protectors 1–6 were struck a total of five separate times at this setting. A second set of testing was performed with protectors 13 and 14, although these protectors were struck only once at the 4000 N setting. The FRD's of protectors 3, 4, 5, 6, 13 and 14, all failed at the 4000 N setting.

Protectors 1–6 had an average reduction force of 2008 N (48%) for the first strike compared to the fifth strike average reduction of 1752 N (41%). Protectors 13 and 14 had an average reduction force of 2018 N (51%) for the first and only strike. The average reduction of force for the foam padding was 1451 N (37%).

It should be noted that the greatest attenuation of force for protectors 1–6 occurred on the strikes wherein the FRD was ruptured. For example the first strike broke protector 5's FRD and resulted in a force reduction of 2220 N (54%). In comparison the first strike on protector 1, which did not cause the FRD to fail, resulted in a force reduction of 1943 N (45%). Thus the failure of a protector's FRD's will account for some of the variation observed between the average of the first and fifth strikes on protectors 1–6.

The FRD's of protectors 3–6 ruptured along the seam of the outer casing during the testing at the 4000 N level. The ruptures varied in size, but were all under 2 cm in length and only allowed a very small portion of the gel to escape. Thus a decision was made to keep testing these protectors to see if there would be a noticeable change in their force attenuation. The results varied considerably between the four protectors. Protector 3 had a first strike reduction of 1720 N (43%) at which point the gel pack broke, but the fifth strike had a force reduction of 1712 N (40%) for only a 3% difference. However, protector 5 had a first strike reduction of 2220 N (54%) and a fifth strike force reduction of 1785 N (44%) for a difference of 10%.

The differences are likely due to the manner in which the FRD's failed; if the rupture propagated upon impact a larger amount of gel would be expelled from the FRD, thus attenuating more force than a small rupture in which only a small amount of gel would be expelled.

7000 N Tests

There were a total of seven separate protectors tested at the 7000 N setting. Protectors 1 and 2, which FRD's were still intact after the earlier tests, and five new protectors (8–12) were tested. All of the protectors FRD's failed at this setting.

Protectors 1 and 2 had an average force reduction of 3532 N (52%), while protectors 8–12 had an average force reduction of 4059 N (58%). The average reduction of force for the foam padding was 3936 N (43%).

Protectors 1 and 2 had significantly lower force attenuation than protectors 8–12. This could be attributed to damage sustained to the FRD's of protectors 1 and 2 in previous tests (a thorough visual inspection of the gel packs was not possible as they were sewn inside the protector padding). Protectors 8–12 provided a measure between protectors that had not been hit before while protectors 1 and 2 had undergone testing at both the 2000 N and 4000 N peak impact force levels.

At the 7000 N peak impact force level the FRD's have a greater effect on the force attenuation than at the other force settings as a reduction of force of 58% was observed compared to a reduction of force of 44% at 2000 N and 48% for 4000 N. This greater increase in force attenuation can be attributed to the failure of the FRD's at the 7000 N impacts. All seven of the protectors FRD's burst quite explosively as the contents of the FRD's often burst forth from the protector. In a few cases the FRD's inner gel pack itself as well as the gel from the outer casing was ejected. Thus a portion of the impact energy was being transferred into ejecting the gel or inner gel pack.

CONCLUSIONS

The average force reduction for the first strike on each of the protectors with the FRD's with the foam padding is shown in Table 1.

TABLE 1

Average Force Reductions

| Impact Forces (N) | Protectors: 1st Strike Average Force Reduction (%) | Foam Padding: Average force Reduction (%) |
|---|---|---|
| 2000 | 44 | 30 |
| 4000 | 48 | 37 |
| 7000 | 58 | 43 |

From the above results the FRD's do improve the attenuation of force of the protectors with the foam padding only. However, this attenuation is at most 15% greater than just the protector alone (this occurred at the 7000 N testing). THis increased attenuation was particularly dependent upon whether or not the gel pack ruptured during the test.

Force Reducing Device

Tested Protector

The FRD is comprised of two individual gel packs; a small inner gel pack which is encased inside of a larger gel pack. The main structure of the protector is 17.8 cm wide by 25.4 cm in length. The inner FRD is 7.6 cm wide by 15.2 cm in length.

Testing System

The same system that was used in testing the hip protectors was once again employed.

Impact Experiments

The impact pendulum was setup to have four nominal peak force level settings of 1600 N, 2000 N, 4000 N and 6000 N. The calibration tests showed that the actual peak forces to be: 1601 N:±41 N, 2020±10 N, 4040±23 N, 5960±60 N, for the nominal peak force levels, respectively. The FRD's were struck only once with the exception of FRD #2.

Results and Discussion

The results of the FRD testing are summarized in the Table 2 on the next page.

TABLE 2

FRD Testing Results

| FRD # | Impact Force (kN) | Gel pack Force (kN) | % Force Absorbed | Notes |
|---|---|---|---|---|
| 1 | 2.02 | 1.75 | 13.3% | Small rupture along seam at top corner of outer gel pack. |
| 2 | 2.02 | 1.62 | 19.8% | FRD remained intact, no ruptures. |
| 3 | 2.02 | 1.04 | 48.5% | The outer gel packs seam blew out along the bottom and sides. |
| 4 | 2.02 | 1.57 | 22.3% | Inner gel pack was blown through the top seam of outer gel pack. |
| 5 | 2.02 | 1.40 | 30.5% | Top left seam of outer gel pack ruptured. |
| 6 | 2.02 | 1.37 | 32.3% | Inner gel pack was blown through the top seam of outer gel pack. |
| 7 | 1.60 | 1.27 | 20.5% | Top left seam of outer gel pack ruptured. |
| 8 | 1.60 | 1.09 | 31.9% | Inner gel pack was blown through the top seam of outer gel pack. |
| 9 | 1.60 | 1.15 | 28.1% | A small hole (approx 1/8/1) appeared at the right corner seam of outer gel pack. |

TABLE 2-continued

FRD Testing Results

| FRD # | Impact Force (kN) | Gel pack Force (kN) | % Force Absorbed | Notes |
|---|---|---|---|---|
| 10 | 4.04 | 1.51 | 62.7% | Inner gel pack was blown through the top seam of outer gel pack. |
| 11 | 4.04 | 1.35 | 66.6% | Inner gel pack was blown through the top seam of outer gel pack. |
| 12 | 6.00 | 2.59 | 56.9% | Inner gel pack was blown through the top seam of outer gel pack. |
| 2 | 6.00 | 2.16 | 64.0% | Inner gel pack was blown through the top seam of outer gel pack. |
| ? | 6.00 | 2.62 | 56.3% | Seams burst along top and sides. *** |

*** There was no inner gel pack in this FRD. (It was not included in the results as it was only tested for curiosity's sake It was observed that the FRD's failed even at the lowest setting (1600 N). The percentage of force attenuation at the nominal peak forces of 1600 N and 2000 N do not differ by much as the average percentage of force attenuated was 26.9% and 27.8% for the 1600 N and 2000 N nominal peak impact forces respectively.

At the highest nominal peak impact force levels of 4000 N and 6000 N the FRD's all failed quite spectacularly. In most cases most of the gel in the outer casing as well as the inner gel pack itself was ejected, thus leading too much larger force attenuations. For the 4000 N setting the average percentage of force attenuated was 64.6% while for the 6000 N setting the average percentage of force attenuated was 59.0%. The average percentage of force attenuated at each peak impact force level is shown in Table 3.

TABLE 3

Gel Pack Force Attenuation

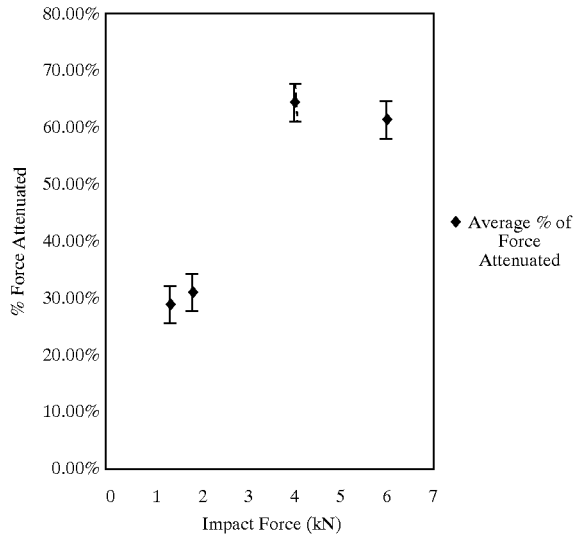

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A fluid filled body padding for fall protection, comprising:

a flexible inner pouch holding a shock absorbing fluid adapted to diffuse applied force;

a flexible outer pouch encapsulating the inner pouch;

a liquid fluid interface between the inner pouch and the outer pouch, the outer pouch being sufficiently filled by liquid that the liquid serves to transmit pressure exerted upon the outer pouch to the inner pouch without the outer pouch physically contacting the inner pouch, the fluid interface serving to pressurize and rigidify the inner pouch containing the shock absorbing fluid when a localized force is exerted upon the outer pouch.

2. The body padding as defined in claim 1, wherein the shock absorbing fluid is a viscous gel-like liquid.

3. The body padding as defined in claim 2, wherein polymer beads are mixed with the viscous gel-like liquid in the inner pouch.

4. The body padding as defined in claim 1, wherein the interface liquid is a viscous gel-like liquid.

5. The body padding as defined in claim 1, wherein foam padding surrounds the outer pouch.

6. The body padding as defined in claim 1, wherein the inner and outer pouch rupture when excessive force is applied.

7. A fluid filled body padding for fall protection, comprising:

a flexible inner pouch holding a viscous gel-like shock absorbing liquid adapting to diffuse applied force, the shock absorbing liquid being mixed with polymer beads;

a flexible outer pouch encapsulating the inner pouch;

a viscous gel-like liquid interface mixed with polymer beads interposed between the inner pouch and the outer pouch, the outer pouch being sufficiently filled by liquid that the liquid serves to transmit pressure exerted upon the outer pouch to the inner pouch without the outer pouch physically contacting the inner pouch, the liquid interface serving to pressurize and rigidify the inner pouch containing the shock absorbing liquid when a localized force is exerted upon the outer pouch; and the flexible inner pouch and flexible outer pouch adapted to rupture when excessive force is applied.

8. A fluid filled body padding for fall protection, comprising:

a flexible inner pouch holding a shock absorbing fluid adapted to diffuse applied force;

a flexible outer pouch encapsulating the inner pouch; and a gaseous fluid interface between the inner pouch and the outer pouch, the outer pouch being sufficiently inflated by the gaseous fluid that the gaseous fluid serves to transmit pressure exerted upon the outer pouch to the inner pouch without the outer pouch physically contacting the inner pouch, the gaseous fluid interface serving to pressurize and rigidify the inner pouch containing the shock absorbing fluid when a localized force is exerted upon the outer pouch.

* * * * *